US005887401A

United States Patent [19]

Moore, Jr.

[11] Patent Number: 5,887,401

[45] Date of Patent: Mar. 30, 1999

[54] CONCRETE FORM SYSTEM

[75] Inventor: James Daniel Moore, Jr., Fort Lauderdale, Fla.

[73] Assignee: Eco-Block LLC, Fort Lauderdale, Fla.

[21] Appl. No.: 899,960

[22] Filed: Jul. 24, 1997

[51] Int. Cl.[6] ..... E04B 2/00

[52] U.S. Cl. ..... 52/426; 52/439

[58] Field of Search ..... 52/426, 439, 309.12, 52/562

[56] References Cited

U.S. PATENT DOCUMENTS

| | | | |
|---|---|---|---|
| D. 378,049 | 2/1997 | Boeshart | D8/354 |
| 1,053,231 | 2/1913 | Schweikert | 52/426 |
| 2,029,082 | 1/1936 | Odam | 52/426 X |
| 2,248,348 | 7/1941 | Hall | 52/426 |
| 3,286,428 | 11/1966 | Kay | 52/496 |
| 4,229,920 | 10/1980 | Lount | 52/309.12 |
| 4,604,843 | 8/1986 | Ott et al. | 52/426 |
| 4,698,947 | 10/1987 | McKay | 42/309 |
| 4,730,422 | 3/1988 | Young | 52/101 |
| 4,742,659 | 5/1988 | Meilleur | 52/426 X |
| 4,765,109 | 8/1988 | Boeshart | 52/426 |
| 4,866,891 | 9/1989 | Young | 52/426 X |
| 4,879,855 | 11/1989 | Berrenberg | 52/309 |
| 4,884,382 | 12/1989 | Horobin | 52/426 |
| 4,888,931 | 12/1989 | Meilleur | 52/426 |
| 4,889,831 | 12/1989 | Boeshart | 52/309.12 X |
| 4,901,494 | 2/1990 | Miller | 52/426 X |
| 5,140,794 | 8/1992 | Miller | 52/426 X |

(List continued on next page.)

FOREIGN PATENT DOCUMENTS

| | | |
|---|---|---|
| 826584 | 11/1969 | Canada . |
| 1145584 | 5/1983 | Canada . |
| 1154278 | 9/1983 | Canada . |
| 1182304 | 2/1985 | Canada . |
| 1194706 | 10/1985 | Canada . |
| 1209364 | 8/1986 | Canada . |
| 1233042 | 2/1988 | Canada . |
| 1234701 | 4/1988 | Canada . |
| 1244668 | 11/1989 | Canada . |
| 1303377 | 6/1992 | Canada . |
| 1304952 | 7/1992 | Canada . |

OTHER PUBLICATIONS

W.A.M. Inc.'s brochure entitled "The ICE (Insulate Concrete Efficiently) Block" (undated).

A Product Profile of the Consulwal™ Concrete Forming System entitled "Concrete Forming, Concrete Block Construction–A Faster Alternative." (Undated).

Promotion al advertisement for "*Quad–Lock Insulated Forms*, " which appeared in Energy Source Builder#36, obtained from Building Technologies, Inc.'s website (Dec. 1994).

(List continued on next page.)

*Primary Examiner*—Carl D. Friedman
*Assistant Examiner*—Beth A. Aubrey
*Attorney, Agent, or Firm*—Needle & Rosenberg, P.C.

[57] ABSTRACT

An insulated concrete form system including two longitudinally-extending side panels, each side panel having an exterior surface and an interior surface, wherein the interior surface of one side panel faces the interior surface of the other side panel and wherein the interior surfaces are laterally spaced apart from each other so that a cavity is formed therebetween, a longitudinally-extending wire re-bar disposed in the cavity formed between the side panels, and at least two connector members. The wire re-bar acts both as a bridging element between the two side panels and as the horizontal structural reinforcement of the concrete (or similar material) placed into the cavity between the side panels. A portion of each connector member is integrally formed within a portion of one side panel so that one connector member is formed within a portion of each of the side panels. Each connector member has an end plate and at least one gripping section, in which the gripping section is adapted to receive a portion of the wire re-bar therein. The gripping sections extend into the cavity formed between the side panels, wherein each connector member in one side panel is spaced apart from all other connector members in the other side panel.

18 Claims, 3 Drawing Sheets

U.S. PATENT DOCUMENTS

| | | | |
|---|---|---|---|
| 5,390,459 | 2/1995 | Mensen | 42/426 |
| 5,459,971 | 10/1995 | Sparkman | 52/309.11 X |
| 5,566,518 | 10/1996 | Martin et al. | 52/426 |
| 5,570,552 | 11/1996 | Nehring | 52/426 |
| 5,611,183 | 3/1997 | Kim | 52/426 |
| 5,625,989 | 5/1997 | Brubaker et al. | 52/309.12 |
| 5,657,600 | 8/1997 | Mensen | 52/309.12 |
| 5,701,710 | 12/1997 | Tremelling | 52/565 X |
| 5,704,180 | 1/1998 | Boeck | 52/309.12 |
| 5,735,093 | 4/1998 | Grutsch | 52/309.12 |

OTHER PUBLICATIONS

Promotional advertisement for "Thermalite" obtained from Thermalite, Inc.'s website (1997).

Promotional advertisement for "Reward" obtained from the internet (undated).

Promotional advertisement for "Polysteel Form" obtained from the internet (undated).

Promotional advertisement for "Isorast –Styropor Forms" obtained Hurricane Homes & Construction Inc.'s website (undated).

Promotional advertisement for "I.C.E. Block Insulating Concrete Form" obtained from Oikos' website (undated).

Promotional advertisement for "The Greenblock System" obtained from Greenblock's website (undated).

Promotional advertisement for "Greenblock Building System" obtained from Greenblock's website (1996).

Promotional advertisement for "Keeva Concrete Foam Froam Wall System" obtained from Keeva's website (undated).

CONCRETE FORM SYSTEM

BACKGROUND OF THE INVENTION

1. Field of the Invention

The present invention encompasses a building component used to make permanent concrete form walls and, more particularly, an insulated concrete form system comprising a plurality of side panels having connecting elements formed therein, in which the connecting elements are coupled by a wire ladder.

2. Background Art

Concrete walls in building construction are most often produced by first setting up two parallel form walls and pouring concrete into the space between the walls. After the concrete hardens, the builder then removes the form walls, leaving the cured concrete wall.

This prior art technique has drawbacks. Formation of the concrete basement walls is inefficient because of the time required to erect the forms, wait until the concrete cures (typically three to seven days), and take down the forms. This prior art technique, therefore, is an expensive, labor-intensive process.

Accordingly, techniques have developed for forming modular concrete walls, which use a foam insulating material. The modular form walls are set up parallel to each other and connecting components hold the two form walls in place relative to each other while concrete is poured therebetween. The form walls, however, remain in place after the concrete cures. That is, the form walls, which are constructed of foam insulating material, are a permanent part of the building after the concrete cures. The concrete walls made using this technique can be stacked on top of each other many stories high to form all of a building's walls. In addition to the efficiency gained by retaining the form walls as part of the permanent structure, the materials of the form walls often provide adequate insulation for the building.

Although the prior art includes many proposed variations to achieve improvements with this technique, drawbacks still exist for each design. The connecting components used in the prior art to hold the walls are constructed of (1) plastic foam, (2) high density plastic, or (3) a metal bridge, which is a non-structural support, i.e., once the concrete cures, the connecting components serve no function. For example, one embodiment of a connecting component is disclosed in U.S. Pat. No. 5,390,459, which issued to Mensen on Feb. 21, 1995 and which is incorporated herein by reference. This patent discloses "bridging members" that comprise end plates connected by a plurality of web members. The bridging members also use reinforcing ribs, reinforcing webs, reinforcing members extending from the upper edge of the web member to the top side of the end plates, and reinforcing members extending from the lower edge of the web member to the bottom side of the end plates. As one skilled in the art will appreciate, this support system is expensive to construct, which increases the cost of the formed wall.

Another disadvantage of prior art devices is that reinforcement of the concrete is necessary because the connecting components provide no structural strength after the concrete cures. Reinforcing steel, known as "re-bar," is normally placed in the cavity between the form walls before pouring the concrete. The re-bar provides horizontal structural integrity to the cured concrete, thereby making "reinforced concrete." The re-bar may be secured to the component holding the two foam panels together. For example, the bridging members in U.S. Pat. No. 5,390,459 are provided with a series of hooked structures to support the re-bar. Thus, in the prior art, not only is there a cost for the connecting component, but also an additional expenditure for the steel re-bar when used.

SUMMARY OF THE INVENTION

The disadvantages of the prior art are overcome by the present invention, which provides a concrete form system comprising at least two longitudinally-extending side panels, a plurality of connector members, and a wire re-bar. The interior surface of one side panel faces the interior surface of another side panel. The opposed interior surfaces are laterally spaced apart from each other a desired separation distance so that a cavity is formed therebetween, into which concrete is poured to form the concrete wall of the building.

Each connector member has an end plate and at least one gripping section, preferably two, each adapted to receive a portion of the wire re-bar therein. The connector members are disposed substantially upright so that one gripping section is disposed above the other gripping section. The gripping sections of the connector members extend into the cavity formed between the side panels and are spaced apart from the gripping sections of the connector members formed within the opposed side panels. Thus, unlike the connector elements in prior art devices, the connector members in the preferred embodiment do not engage each other, but, instead, each independently contact the wire re-bar.

Preferably, the wire re-bar is in the shape of a wire ladder comprising two longitudinally-extending wires and at least two rungs connecting the two wires. Preferably, the length of the rungs is substantially equivalent to the desired lateral spacing between the gripping sections of the different side panels. Thus, the wire Ad ladder provides reinforcing strength to the concrete placed between the two side panels, once the concrete is cured, and also serves as a "bridge" to establish the desired lateral separation between the side panels. Since wire ladder is available for other purposes, as opposed to being a speciality product, the cost of the present invention is further reduced from the prior art. One skilled in the art will also appreciate that the wire re-bar provides horizontal structure reinforcing steel which takes the place of conventional steel re-bar used in the prior art devices.

Therefore, unlike the prior art, the present invention uses a connector element that also acts as a reinforcing component of the concrete wall. Other advantages of the present invention are the reduced weight from the prior art devices, the simplicity in design, and the lower cost.

DETAILED DESCRIPTION OF THE INTENTION

Figure 1:
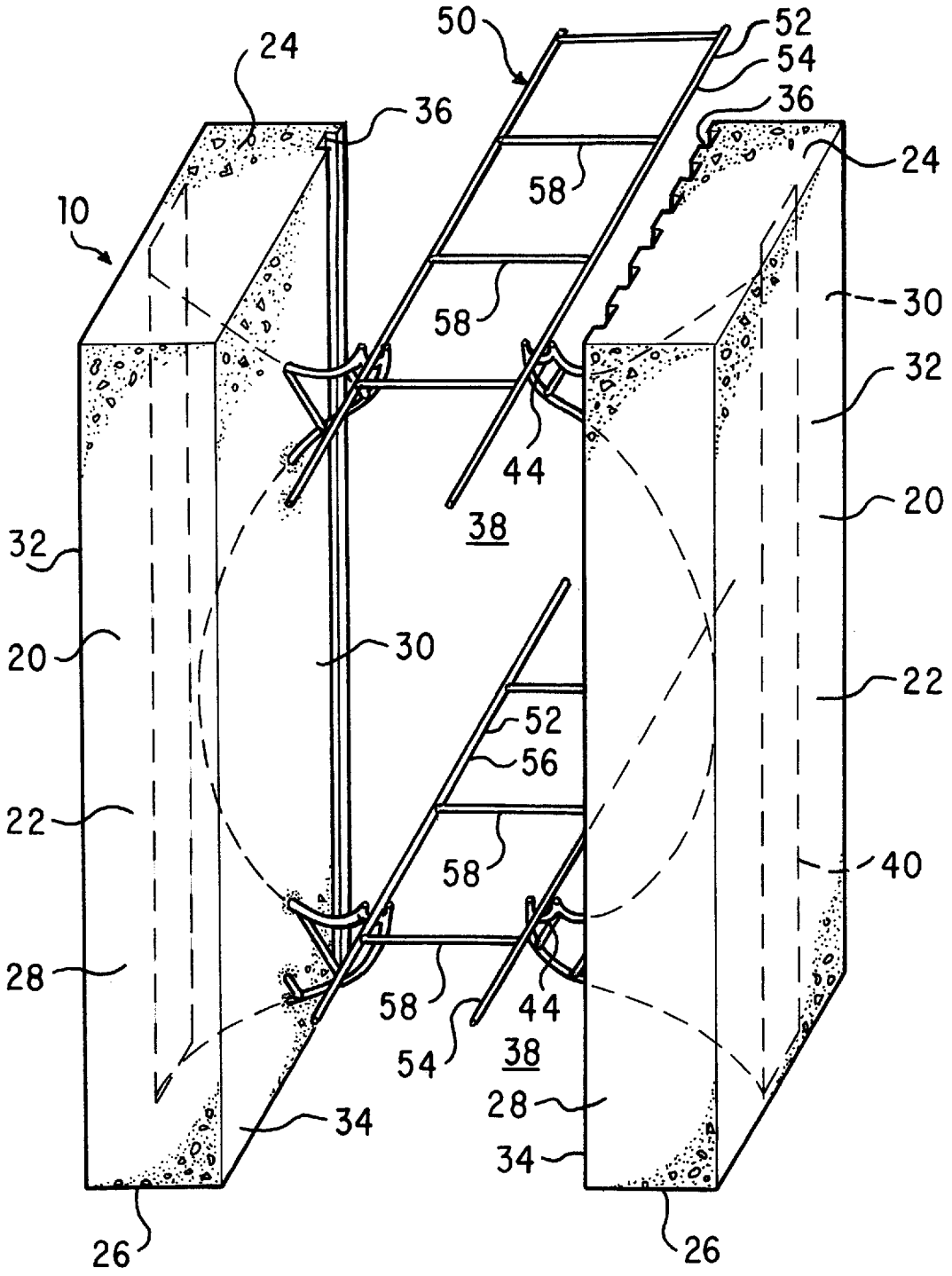
FIG. 1 is a front perspective view of the preferred embodiment of the present invention.

The present invention is more particularly described in the following examples that are intended as illustrative only since numerous modifications and variations therein will be apparent to those skilled in the art. As used in the specification and in the claims, "a" can mean one or more, depending upon the context in which it is used. The preferred embodiment is now described with reference to the figures, in which like numbers indicate like parts throughout the figures.

As shown in FIGS. 1–5C, the present invention is a concrete form system 10 used for constructing buildings, which comprises at least two longitudinally-extending side panels 20 (including a first side panel and a second side panel) a plurality of connector members 40 in which at least one of the connector members 40 is integrally formed with each of the side panels 20, and a wire re-bar 50. Each side panel 20 has a body portion 22, a top end 24, a bottom end 26, a first end 28, a second end 30, an exterior surface 32, and an interior surface 34. The presently preferred side panel 20 has a thickness (separation between the interior surface 34 and exterior surface 32) of two and a half (½) inches, a height (separation between the bottom end 26 and the top end 24) of sixteen (16) inches, and a length (separation between the first end 28 and second end 30) of forty-eight (48) inches. The dimensions can be altered, if desired, for different building projects, such as increasing the thickness for increased insulation. Half sections of the side panels can be used for footings.

When used in construction, the interior surface 34 of one side panel 20 (the first side panel) faces the interior surface 34 of another side panel 20 (the second side panel) and the opposed interior surfaces 34 are laterally spaced apart from each other a desired separation distance so that a cavity 38 is formed therebetween. Concrete is poured into the cavity 38 to form the wall. Preferably, the opposed interior surfaces 34 are parallel to each other. The cavity 38 between two opposed side panels 20 receives a volume of concrete that is defined by the separation between the interior surfaces 34, the height of the side panels 20, and the length of the side panels 20. The interior surface 34 preferably includes a series of indentations 36 therein that increases the surface area between the side panels 20 and concrete to enhance the bond therebetween.

The side panels 20 are preferably constructed of polystyrene, specifically expanded polystyrene, which provides thermal insulation and sufficient strength to hold the poured concrete until it cures. The formed concrete wall using polystyrene with the poured concrete has a high insulating value so that no additional insulation is usually required. In addition, the formed walls have high impedance to sound transmission.

Figure 4:
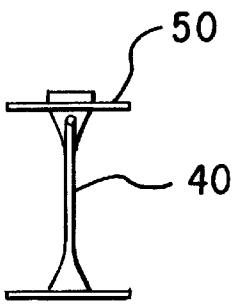
FIG. 4 is a top plan view of the connection member in FIG. 2.

As shown in FIGS. 1, 2, and 5A–5C, a portion of each connector member 40 is integrally formed within a portion of one side panel 20. Each side panel 20 has at least one connector member 40 formed into it. Each connector member 40 has an end plate 42, at least one gripping section 44 adapted to receive a portion of the wire re-bar 50 therein (as shown in FIG. 4), and a cross-section 46 connecting the gripping sections 44 to the end plate 42.

The gripping sections 44 of the connector members 40 extend into the cavity 38 formed between the side panels 20. As shown in FIGS. 1 and 5A–5C, the gripping section 44 of each connector member 40 formed within one side panel 20 (the first side panel) is spaced apart from the gripping sections 44 of the connector members 40 formed within another side panel 20 forming the opposed longitudinal boundary of the cavity 38 (the second side panel). Specifically, the gripping section 44 of each connector member 40 formed within a portion of one side panel 20 in the preferred embodiment is laterally spaced apart a desired distance from the gripping sections 44 of the other connector members 40 integrally formed within a portion of the opposed side panel 20. Thus, unlike the connector elements in prior art devices, the connector members 40 in the preferred embodiment do not engage each other, but, instead, each independently contact the wire re-bar 50. The desired distance that the interior surfaces 34 of the side panels 20 are separated is two (2) inches, with other variations of four (4), six (6), and eight (8) inch or greater separation. Typically, the gripping sections extend three quarters (¾) of an inch into the cavity 38 from the interior surface 34 of the respective side panel 20. As one skilled in the art will appreciate, the design of the present invention provides increased flexibility over the prior art devices because there is no requirement for an exact alignment of opposed side panels 20 and connecting components. However, the present invention preferably uses opposed side panels 20 that are symmetrical with each other as shown in FIGS. 1 and 5A–5C.

Figures 5A, 5B, 5C:
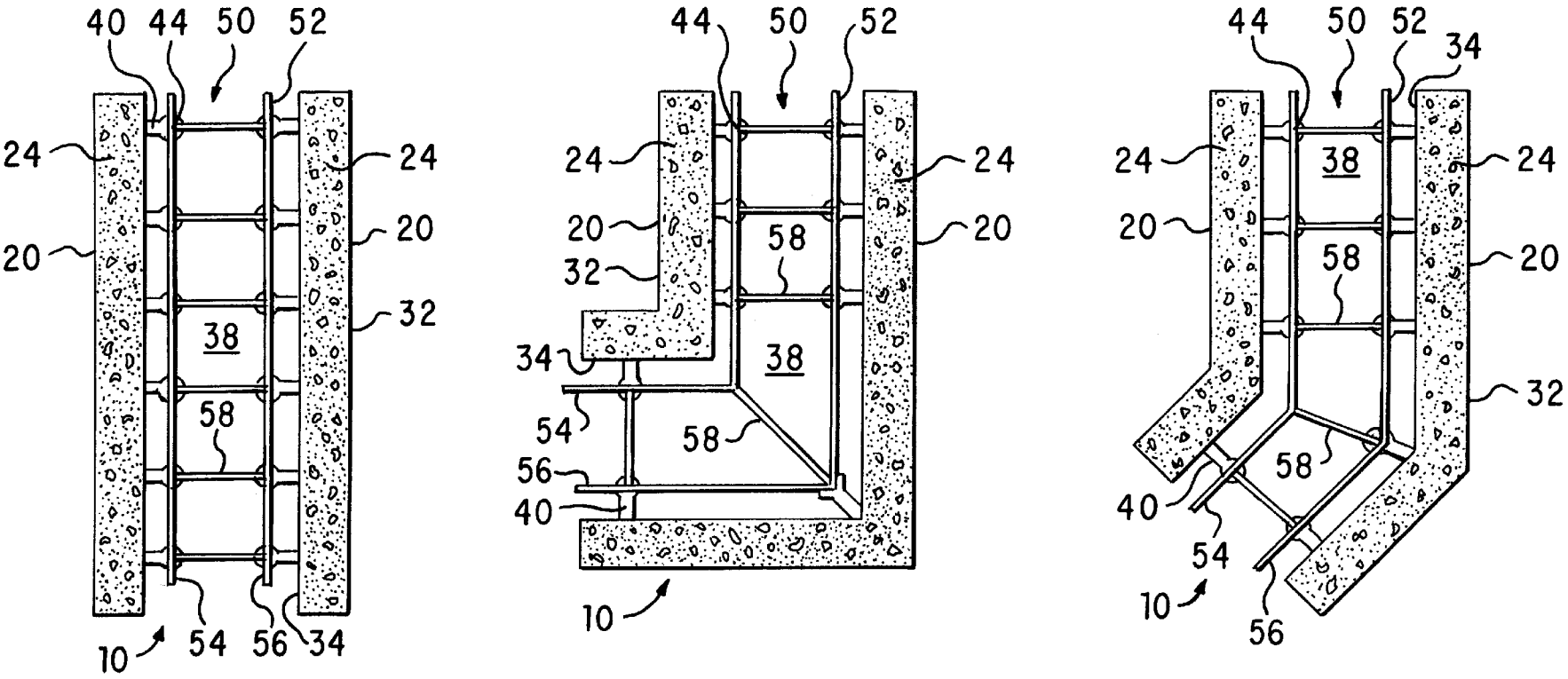
FIG. 5A is a top plan view of the preferred embodiment of FIG. 1, in which the side panels are straight.
FIG. 5B is an alternative top plan view of FIG. 5A, in which a corner section is used that forms a right angle.
FIG. 5C is another alternative top plan view of FIG. 5A, in which a corner section is used that forms a forty-five degree angle.

Preferably, the gripping sections 44 of each connector member 40 formed within the longitudinally-aligned side panels 20 are separated a predetermined longitudinal distance, which is typically eight (8) inches. Based on the preferred length of the side panel 20 of forty-eight inches, six connector members 40 are formed within each side panel 20. Obviously, FIG. 1 is a truncated view of the preferred side panels 20 since they show a single connector member 40 in each respective side panel 20. FIGS. 5A–5C, however, show multiple connector members 40 in each side panel 20.

Referring again to FIGS. 1 and 2, each connector member 40 preferably has two separate gripping sections 44 (a first gripping section and a second gripping section). The connector members 40 are also preferably disposed substantially upright so that one gripping section 44 (the first gripping section) is disposed above the other gripping section 44 (the second gripping section). As one skilled in the art will appreciate, the number of gripping sections 44 used in each connector member 40 can be varied based on various factors, such as the dimensions of the side panels 20 and the number of wire re-bars 50 needed to obtain the desired wall strength or reinforcement. At least two gripping sections 44 is desired for proper vertical alignment.

Figure 3:
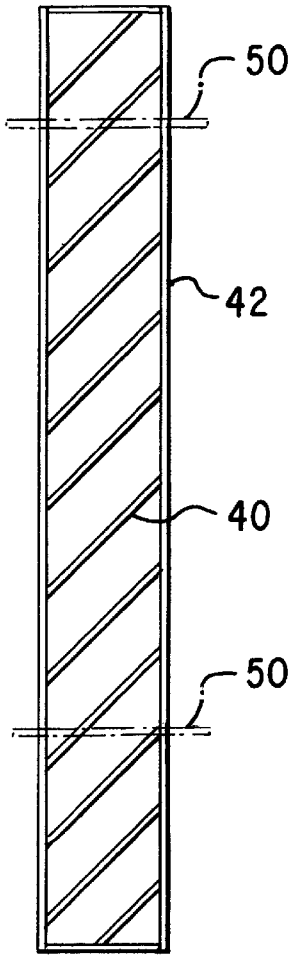
FIG. 3 is a side view of the connection member in FIG. 2
Figure 2:
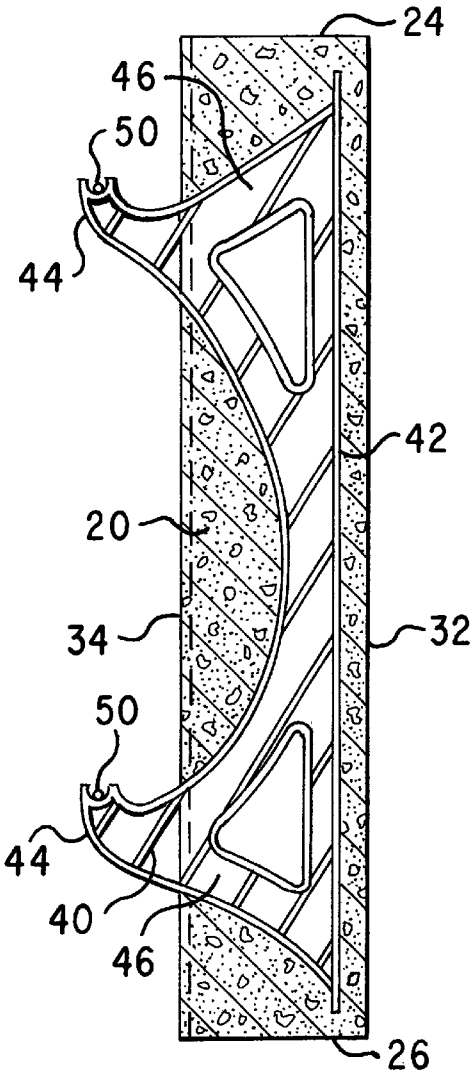
FIG. 2 is a side cross-sectional view of a side panel showing a connection member integrally formed therewith.

The end plates 42 of the connector members 40 are substantially rectangular in plan view, which is illustrated in FIG. 3. As best shown in FIGS. 1 and 2, each end plate 42 of the connector members 40 are completely disposed within a portion of one respective side panel 20. That is, the end plates 42 are located slightly below the exterior surface 32 of, or recessed within, the side panel 20, preferably at a distance of one-quarter (¼) of an inch from the exterior surface 32. This allows for easily smoothing the surface of the side panels 20 without cutting the end place 42 should the concrete, when poured, create a slight bulge in the side panels 20. As an alternative embodiment, the end plates 42 can abut the exterior surface 32 of panels so that a portion of the end plate 42 is exposed on the exterior surface 32. It is also preferred that the end plate 42 is oriented substantially parallel to the exterior surface 32 of the side panel 20 and disposed substantially upright.

The connector members 40 are preferably constructed of plastic, more preferably high-density polyethylene, although polypropylene and other suitable polymers may be used.

Factors used in choosing the material include the desired strength of the connector member 40 and its compatibility with the material used to form side panels 20. Another consideration is that the end plates 42 should be adapted to receive and frictionally hold a metal fastener, such as a nail or screw, therein, thus providing the "strapping" for a wall system that provides an attachment point for gypsum board (not shown), interior or exterior wall cladding (not shown), or other interior or exterior siding (not shown). Thus, the connector members 40 function to align the side panels 20, hold the side panels 20 in place during a concrete pour, and provide strapping to connect siding and the like to the formed concrete wall.

Referring again to FIGS. 1 and 5A–5C, the longitudinally-extending wire re-bar 50 is disposed in the cavity 38 formed between the side panels 20. Preferably, the wire re-bar 50 is wire ladder 52 comprising two longitudinally-extending wires 54, 56 and at least two rungs 58 connecting the two wires 54, 56, all of which are formed of steel. Each wire 54, 56 is sized to be complementarily received within the gripping section 44 of a respective one the connector members 40, preferably by being snapped into place for ease of assembly. The diameter of the preferred embodiment of wire 54, 56 is one quarter (¼) inch. The two wires 54, 56 are preferably laterally spaced apart from each other so that the first wire 54 is disposed within the gripping sections 44 of the connector members 40 integrally formed within one side panel 20 and the second wire 56 is disposed within the gripping sections 44 of the connector members 40 integrally formed within a portion of the opposed side panels 20.

Each rung 58 of the wire ladder 52 has opposed ends and a length extending therebetween. One end of the rung 58 is fixedly attached to the first wire 54 and the opposed end is fixedly attached to the second wire 56. Preferably, the length of the rungs 58 is substantially equivalent to the desired lateral spacing between the gripping sections 44 of the different side panels 20. Thus, the wire ladder 52 not only provides reinforcing strength, but also can be used as a "bridge" to establish the desired lateral separation between the gripping sections 44 and, accordingly, the side panels 20. The builder, therefore, can change the dimensions of the wire ladder 52, as desired, to change the separation distance between the side panels 20.

As one skilled in the art also appreciates, wire ladder 52 is available for other purposes, as opposed to being a speciality product only, which reduces the cost of the present invention. One skilled in the art will also appreciate that the wire re-bar 50 provides horizontal structure reinforcing steel which takes the place of, and in most instances replaces, the need for conventional single wire steel re-bar (not shown). Similar to the wire 54, 56, the diameter can be one quarter (¼) inch or other dimension as required for the necessary horizontal reinforcement, depending on the thickness of the concrete wall and the designed engineering requirements.

Another contemplated alternative embodiment of the present invention uses one, single-wire re-bar, instead of a wire ladder 52, as the wire re-bar 50. In this embodiment which is not shown, the gripping portions extending from the opposed side panels 20 are, at least slightly, longitudinally staggered since they both receive and hold the same single-wire re-bar. The separation distance between the panels is thus determined by the extension of the gripping rungs 58 from the interior surface 34 of the side panels 20 since the "bridging" rungs 58 of the wire ladder 52 are not used.

Although not explicitly shown, one skilled in the art will appreciate that a plurality of side panels 20 can be longitudinally aligned to form a predetermined length and be vertically stacked to form a predetermined height. The first end 28 of one side panel 20 abuts the second end 30 of another side panel 20 and the bottom end 26 of one side panel 20 is disposed on the top end 24 of another side panel 20. Thus, a series of side panels 20 can be aligned and stacked to form the concrete form system 10 into which concrete is poured to complete the wall. One consideration, however, is that the side panels 20 are not vertically stacked too high and filled at one time so that the pressure on the bottom side panel 20 is greater than the yield strength of the polystyrene. Instead, the stacked wall can be filled and cured in stages so that the pressure is not excessive on the lower side panels 20.

In order to facilitate the stacking of the components, the side panels 20 are optionally provided with a series of projections and indentations (not shown) that complementarily receive offset projections and indentions from another side panel 20. The projections and indentations in the adjacent side panels 20 mate with each other to form a tight seal that prevents leakage of concrete during wall formation and prevents loss of energy through the formed wall.

Referring now to FIGS. 5B and 5C, the present invention also uses corner sections. Preferably, each corner section forms a substantially right angle as shown in FIG. 5B and concrete is also poured into the comer section similar to the other sections of the concrete form system 10. Forty-five degree angle comer sections are also used, as shown in FIG. 5C. Thus, using the comer sections, the formed concrete wall is contiguous for maximum strength, as opposed to being separate connected blocks. Still another embodiment of the present invention which is not shown uses non-linear side panels 20 so that the formed wall has curvature instead of being straight.

Although the present invention has been described with reference to specific details of certain embodiments thereof, it is not intended that such details should be regarded as limitations upon the scope of the invention except as and to the extent that they are included in the accompanying claims.

What is claimed is:

1. A concrete form system, comprising:

a. two longitudinally-extending side panels including a first side panel and a second side panel, each side panel having an exterior surface and an interior surface, wherein a portion of the interior surface of said first side panel faces a portion of the interior surface of said second side panel and wherein the interior surfaces of said first and second side panels are laterally spaced apart so that a cavity is formed therebetween;

b. a longitudinally-extending re-bar; and c. at least two connector members in which each connector member has a unitary, integrally-formed body, a portion of each individual connector member formed within one respective side panel so that each individual connector member is partially disposed within a selected one of said first and second side panels, each connector member having an end plate and at least one gripping section adapted to receive a portion of said re-bar therein, said gripping sections extending into the cavity formed between said first and second side panels, wherein said connector member partially disposed within said first side panel is spaced apart from said connector member partially disposed within said second side panel, wherein said re-bar connects said connecting members partially disposed within said respective first and second side panels.

2. The concrete form system of claim 1, wherein the gripping section of said connector member partially disposed within said first side panel is laterally spaced apart a desired distance from the gripping section of said connector member partially disposed within said second side panel.

3. The concrete form system of claim 2, wherein at least two connector members are partially disclosed within said first side panel including a forward and a rear connector member and wherein the gripping section of said forward connector member partially disposed within said first side panel is longitudinally spaced apart a predetermined distance from the gripping section of said rear connector member partially disposed within said first side panel.

4. The concrete form system of claim 1, wherein said connector members are constructed of plastic.

5. The concrete form system of claim 4, wherein said plastic is high-density polyethylene.

6. The concrete form system of claim 1, wherein said side panels are constructed of polystyrene.

7. The concrete form system of claim 1, wherein the end plates of said connector members are substantially rectangular in plan view.

8. The concrete form system of claim 7, wherein the end plates of said connector members are adapted to receive a metal fastener and frictionally hold the metal fastener therein.

9. The concrete form system of claim 7, wherein the end plates of said connector members are disposed within said respective side panels and wherein said end plates are oriented substantially parallel to the exterior surfaces of said side panels.

10. The concrete form system of claim 1, wherein said re-bar comprises:

a. two longitudinally-extending wires including a first wire and a second wire, said first wire laterally spaced apart from said second wire so that said first wire is received within the gripping section of said connector member partially disposed within said first side panel and said second wire is received within the gripping section of said connector member partially disposed within said second side panel; and b. a plurality of rungs, each rung having opposed ends and a length extending therebetween, one end fixedly attached to said first wire and the opposed end fixedly attached to said second wire.

11. A concrete form system, comprising:

a. two longitudinally-extending side panels including a first side panel and a second side panel, each side panel having an exterior surface and an interior surface, wherein a portion of the interior surface of said first side panel faces a portion of the interior surface of said second side panel and wherein the interior surfaces of said first and second side panels are laterally spaced apart so that a cavity is formed therebetween;

b. a longitudinally-extending re-bar; and c. at least two connector members, a portion of each individual connector member formed within one respective side panel so that each individual connector member is partially disposed within a selected one of said first and second side panels, each connector member having an end plate and at least one gripping section adapted to receive a portion of said re-bar therein, said gripping sections extending into the cavity formed between said first and second side panels, wherein said connector member partially disposed within said first side panel is spaced apart from said connector member partially disposed within said second side panel, wherein said re-bar connects said connecting members partially disposed within said respective first and second side panels, wherein said connector members have two separate gripping sections.

12. The concrete form system of claims 11, wherein the two separate gripping sections of said connector members include a first gripping section and a second gripping section, and wherein said connector members are disposed substantially upright so that said first gripping section is disposed above said second gripping section.

13. In combination:

a. two longitudinally-extending side panels including a first side panel and a second side panel, each side panel having an exterior surface and an interior surface, wherein the interior surface of said first side panel faces the interior surface of said second side panel and wherein the interior surfaces of said first and second side panels are laterally spaced apart so that a cavity is formed therebetween;

b. a longitudinally-extending re-bar disposed in the cavity formed between said side panels; and c. at least two connector members in which each connector member has a unitary, integrally-formed body, a portion of each individual connector member formed within one respective side panel so that each individual connector member is partially disposed within a selected one of said first and second side panels, each connector member having at least one gripping section adapted to receive a portion of said re-bar therein, said gripping sections extending into the cavity formed between said first and second side panels, wherein said connector member partially disposed within said first side panel is spaced apart from said connector member partially disposed within said second side panel.

14. The combination of claim 13, wherein said re-bar comprises:

a. two longitudinally-extending wires including a first wire and a second wire, said first wire laterally spaced apart from said second wire so that said first wire is received within the gripping sections of said connector members which are partially disposed within said first side panel and said second wire is received within the gripping sections of said connector members partially disposed within said second side panel; and b. a plurality of rungs, each rung having opposed ends and a length extending therebetween, one end fixedly attached to said first wire and the opposed end fixedly attached to said second wire.

15. The combination of claim 14, wherein the gripping section of each connector member partially disposed within said first side panel is laterally spaced apart a desired distance from the gripping section of said connector member partially disposed within said second side panel, wherein the length of said rungs is substantially equivalent to the desired distance.

16. A method of constructing a reinforced concrete wall, comprising the steps of:

a. placing at least two longitudinally-extending side panels including a first side panel and a second side panel apart, each side panel having at least one connector member partially disposed therein and an interior surface so that a portion of the interior surface of said first side panel faces a portion of the interior surface of said second side panel, wherein said interior surfaces are laterally spaced apart so that a cavity is formed therebetween;

b. aligning said connector members, each connector member having a unitary, integrally-formed body and having at least one gripping section adapted to receive a portion of a re-bar therein so that said gripping sections extend into the cavity formed between said side panels, wherein said connector member partially disposed within said first side panel is spaced apart from said connector member partially disposed within said second side panel; and c. engaging a portion of said re-bar into the gripping sections of said respective connector members partially disposed within said first and second side panels so that said re-bar connects said connecting members.

17. The method of claim 16, wherein said re-bar comprises:

a. two longitudinally-extending wires including a first wire and a second wire, said first wire laterally spaced apart from said second wire so that said first wire is received within the gripping sections of said connector members which are partially disposed within said first side panel and said second wire is received within the gripping sections of said connector members partially disposed within said second side panel; and b. a plurality of rungs, each rung having opposed ends and a length extending therebetween, one end fixedly attached to said first wire and the opposed end fixedly attached to said second wire.

18. A concrete form system, comprising:

a. two longitudinally-extending side panels including a first side panel and a second side panel, each side panel having an interior surface wherein a portion of the interior surface of said first side panel faces a portion of the interior surface of said second side panel, and wherein the interior surfaces of said first and second side panels are laterally spaced apart, so that a cavity is formed therebetween; and b. at least two connector members, a portion of each individual connector member formed within one respective side panel so that each individual connector member is partially disposed within a selected one of said first and second side panels, each connector member having two separate gripping sections each adapted to receive a portion of a re-bar therein, said gripping sections extending into the cavity formed between said first and second side panels, wherein said connector member partially disposed within said first side panel is spaced apart from said connector member partially disposed within said second side panel, wherein the re-bar connects said connecting members partially disposed within said respective first and second side panels.

* * * * *